United States Patent [19]

Knapp

[11] 4,364,485

[45] Dec. 21, 1982

[54] INJECTABLE FLUID CONTAINER AND METHOD

[75] Inventor: Julius Z. Knapp, Somerset, N.J.

[73] Assignee: Schering Corporation, Kenilworth, N.J.

[21] Appl. No.: 263,816

[22] Filed: May 15, 1981

[51] Int. Cl.[3] ..... B65D 41/14; B65D 41/20; B65D 41/30

[52] U.S. Cl. ..... 215/232; 215/247; 53/53; 53/489

[58] Field of Search ..... 215/232, 233, 247, 230, 215/DIG. 3; 53/53, 489, 471

[56] References Cited

U.S. PATENT DOCUMENTS

| | | | |
|---|---|---|---|
| 1,413,703 | 4/1922 | Biehn . | |
| 2,628,735 | 2/1953 | McGowan | 215/232 |
| 2,734,649 | 2/1956 | Callahan et al. | 215/233 |
| 2,937,481 | 5/1960 | Palmer | 53/471 |
| 3,013,687 | 12/1961 | Gould | 215/DIG. 3 X |
| 3,071,274 | 1/1963 | Ravn | 215/37 |
| 3,193,128 | 7/1965 | Ravn | 215/42 |
| 3,278,063 | 10/1966 | Kranzhoff | 215/38 |
| 3,358,865 | 12/1967 | Andersen | 215/38 |
| 3,501,042 | 3/1970 | Risch et al. | 215/40 |
| 3,664,083 | 5/1972 | Fradin et al. | 53/53 |
| 3,736,899 | 6/1973 | Manske | 215/230 X |
| 3,871,545 | 3/1975 | Bereziat | 215/249 |
| 4,109,815 | 8/1978 | Collins | 215/232 |
| 4,171,084 | 10/1979 | Smith | 215/232 X |
| 4,227,954 | 10/1980 | Ward et al. | 156/250 |
| 4,285,188 | 8/1981 | Morton | 53/489 X |

*Primary Examiner*—William Price
*Assistant Examiner*—Sue A. Weaver
*Attorney, Agent, or Firm*—Warrick E. Lee, Jr.; Vincent H. Gifford; Bruce M. Eisen

[57] ABSTRACT

A pilfer-proof container for injectable fluid. An inner seal having an opening is fixedly secured to the neck of a bottle to hold a stopper. An outer seal covers the opening and is removably attached to the inner seal with non-flaking, non-rebondable adhesive.

The sealing system allows inspection of the stopper after the inner seal has been attached.

16 Claims, 1 Drawing Figure

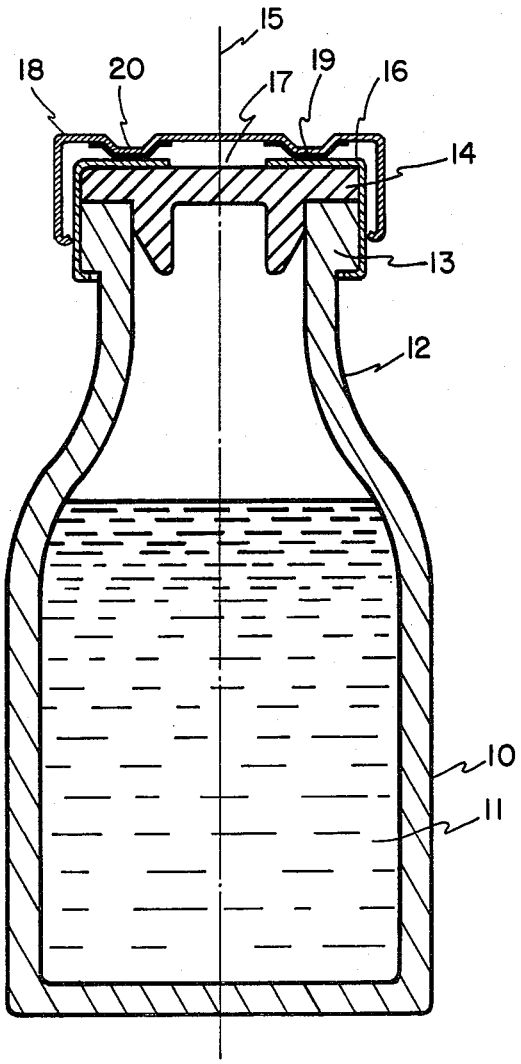
15
18
20
17
19
16
14
13
12
10
11

INJECTABLE FLUID CONTAINER AND METHOD

This invention relates to a container for injectable liquids, and more specifically to an improved closure system for such containers. The new closure system is pilfer-proof and safe to use. In addition it insures product integrity.

Prior-art closure systems, as exemplified by U.S. Pat. Nos. 3,358,865 and 3,071,274, utilize a pre-assembled, two-part closure system that is attached to the container in a single step. The stopper is exposed by removing one part of the seal, causing the two parts to separate along a pre-scored tear line in the metal of one of the seals. The user then penetrates the stopper with a hypodermic needle and withdraws the desired amount of the bottle's contents.

These prior-art systems are pilfer-proof in that it would be readily apparent if the package had been previously opened by an unauthorized user. However, the tearing of metal required to open the package generates undesirable metal fragments. Furthermore, it is possible to produce sharp metal edges that pose obvious safety hazards to the users.

Another disadvantage of these prior art systems is that by attaching the pre-assembled two-part closure system in one step, a convenient opportunity to inspect the stopper is sacrificed.

One aspect of the present invention comprises a pilfer-proof container for an injectable fluid comprising:

(a) a bottle having a neck, (b) an elastomeric stopper sealing said neck, (c) a inner seal fixedly secured to said neck to hold said stopper, said inner seal having an opening to allow penetration of said stopper, and (d) an outer seal covering said opening removably attached to said inner seal with adhesive adapted to seal around said opening, said adhesive being non-flaking and non-rebondable upon removal of said outer seal.

A second aspect of the invention comprises a closure for a container of injectable fluid comprising:

(a) an inner seal having an opening adapted to be fixedly secured to a container's neck, (b) an outer seal adapted to cover said opening, and (c) adhesive bonded to at least one of said seals adapted to removably attach said seals and to seal around said opening, said adhesive being non-flaking and non-rebondable after attachment and subsequent separation of said seals.

A third aspect of the invention comprises a method of assembling and inspecting a container of injectable fluid wherein said container has a neck comprising the steps of:

(a) sealing said neck with an elastomeric stopper, (b) fixedly securing an inner seal to said neck to hold said stopper, said inner seal having an opening to allow penetration of said stopper, (c) inspecting the bottle-stopper-inner seal assembly produced in step (b) for presence of stopper and absence of dimpling, and, thereafter for assemblies passing inspection, (d) removably affixing an outer seal over said opening with adhesive adapted to seal around said opening, said adhesive being non-flaking and non-rebondable upon removal of said outer seal.

The sole FIGURE is a longitudinal sectional view of a container of injectable fluid in accordance with the invention.

Referring to the FIGURE, there is shown container 10, typically a glass bottle, containing injectable fluid 11. The fluid may be any injectable medicament such as gentamicin, penicillin, etc. The container has a neck 12 and preferably a flange 13 on the neck. An elastomeric stopper 14 seals the neck.

Preferably all of the parts of the invention are circular in cross-section when cut by a plane perpendicular to axis 15. Thus rotation of the elements of FIG. 1 about axis 15 would generate the preferred shape of the invention in 3 dimensions. Of course other shapes are acceptable.

Stopper 14 is held in place by an inner seal 16 fixedly secured to neck 12, preferably by crimping the inner seal under flange 13 of neck 12. Other methods of fixedly securing the inner seal to the neck are acceptable, provided that the inner seal cannot be removed without its destruction. U.S. Pat. No. 3,871,545 discloses an alternate method of securing an inner seal to a container's neck.

The inner seal is preferably made of a crimpable metal such as 0.003" to 0.01" (more preferably 0.006") thick aluminum. The inner seal has an opening 17 to allow penetration of stopper 14, as will be explained presently.

An outer seal 18, preferably in the shape of a loose-fitting cap made of 0.003" to 0.01" (more preferably 0.008") thick aluminum, covers opening 17 in the inner seal. The outer seal is attached to inner seal 16 with non-flaking, non-rebondable adhesive 19 to provide a sterile seal around opening 17.

The adhesive must be non-flaking and non-rebondable upon removal of the outer seal. That is, the adhesive must not form undesirable flakes when the outer seal is removed by the user, who opens the container by pushing the outer seal away from the inner seal, causing the adhesive to lose its grip. Furthermore, it must not be possible to rebond the outer seal to the inner seal without special apparatus or chemicals. Common water-soluble glues are obviously unacceptable, since they form flakes and may be rebonded by simply moistening the glue. Adhesives that are permanently sticky, such as those commonly used to affix price tags to articles in retail stores, are unacceptable because they are easily rebondable.

The preferred non-flaking, non-rebondable adhesive is a thin layer of thermoplastic laminated to a least one of the seals, preferably the outer seal. Preferred thermoplastics are polyvinyl chloride, polyethylene, polypropylene, ethylene copolymers, propylene copolymers and blends thereof. The thermoplastic may be laminated to the outer seal by spraying a thin coating of molten thermoplastic onto the inner side of the outer seal at a coverage of about one pound per 1000 square feet. Alternately the thermoplastic could be dissolved in solvent, and the resulting solution coated onto the outer seal. Upon evaporation of the solvent, the lamination would be complete.

To removably attach the inner and outer seals, the thin layer of thermoplastic is melted while the two seals are in contact with each other, as described in detail later. Once the user separates the seals to open the container, rebonding of the adhesive is not possible without special apparatus or chemicals. If an unauthorized person reattaches the seals with a different adhesive, the extra adhesive would be readily apparent to the authorized user.

The invention is used as follows.

First outer seal 18 is removed by pushing upward, causing adhesive 19 to loose its grip. This is easily accomplished by holding the container in the fingers of one hand and flipping the cap off with a flick of the thumb. This exposes opening 17 and the top of stopper 14. Next a hollow needle, such as a hypodermic needle, is pushed through opening 17, through stopper 14 and into fluid 11. The appropriate amount of fluid is withdrawn through the hollow needle, and the needle is retracted from the stopper. To prevent dust from settling on stopper 14, outer seal 18 may be placed over inner seal 16 when the opened container is not in use. However, it is not possible to rebond the outer seal without special apparatus or chemicals, hence the container is pilfer proof.

A highly desirable method by which the new closure system may be applied to a bottle containing injectable liquids is now described. Obvious sterilization steps have been omitted.

After container 10 has been filled with fluid, neck 12 is sealed with stopper 14. Stoppers other than the type shown in FIG. 1 may be used. For example, the stopper may be a disk that sits on the top of flange 13. After the stopper is in place, inner seal 16, which has not yet been attached to outer seal 18, is crimped under flange 13 to firmly hold the stopper.

Next a very important step, not practical with prior-art pre-assembled closure systems is performed. With the inner seal crimped under flange 13, an inspection is performed to make sure (1) that the stopper is present, and (2) that the stopper is not dimpled. Sometimes automatic machinery fails to place a stopper in a container's neck. Obviously, absence of a stopper would render the container defective; hence bottles not having stoppers are not processed further. Another problem to be guarded against, is that crimping is occasionally performed improperly, causing the stopper to have a depression in its surface. This depression, or dimple, which is visible through opening 17 in ferrule 16, frequently indicates the presence of an air channel along the stopper, that can breach sterility. Hence containers having dimpled stoppers are not processed further.

Preferably the inspection is performed at high speed by automatic inspecting means. For example, a beam of light could be shined onto the top of the stopper and reflected from the stopper to a light sensor capable of detecting variations in intensity or direction of the reflected beam. Such variations from a norm for properly placed stoppers would indicate dimpling or absence of the stopper. Alternate mechanical means to "feel" for a properly placed stopper could be devised.

The high speed inspection for presence of stopper and absence of dimpling in the stopper is made possible by the seemingly inefficient method of failing to pre-attach the inner and outer seals. Yet the inspection results in eliminating those containers having stopper deficiencies, thereby allowing the manufacturer to comply with a zero-defects program in a manner not possible with the prior-art's pre-assembled seals.

When pre-assembled seals are used, it is not possible to inspect for dimpling, and presence of stopper can be determined only by viewing the stopper from its underside, through the bottle.

After the inspection step, outer seal 18 is applied. Typically made of aluminum or plastic having a high softening point, cap 18 is lined on its inner surface with a non-flaking, non-rebondable adhesive 19. The preferred adhesives are the previously described thermoplastics having low softening points, especially a polyvinyl chloride that softens and becomes adhesive when heated to 250° F. under pressure of 30 to 40 psi.

To affix the outer seal to the inner seal, the outer seal 18 is pressed over inner seal 16, and heat or ultrasonic energy is used to melt the adhesive, thereby affixing the seals together and protecting opening 17. Heating the thermoplastic to 200° to 300° C. (preferably 250° C.) for 150 to 300 milliseconds (preferably 200 milliseconds) while applying pressure at about 30 to 40 psi., provides a sufficient seal. If one of the seals is constructed of metal, it can be conveniently heated by inductive heating, to melt the thermoplastic in contact with it.

It is preferable to have a circular channel 20 stamped into outer seal 18, so that attachments of outer seal 18 to inner seal 16 occurs only at the channel. By varying the contact area of the channel and/or the formulation of the adhesive, the holding power of the adhesive can be adjusted so that the two seals are attached firmly enough to prevent accidental removal during storage and shipment, yet not so firmly that easy removal by a flick of the user's thumb is prevented. When using thermoplastic adhesive, channel 20 preferably has an inner diameter of 0.43" and outer diameter of 0.45".

To help center outer seal 18 over opening 17, rolled edges on the bottom of the outer seal are helpful. The rolled edges, which are shown unlabeled in the drawing, also prevent the outer and inner seals from bonding to each other along their vertical edges when adhesive has been applied to the entire surface of the outer seal.

The present invention has these advantages over the closure systems disclosed in U.S. Pat. Nos. 3,358,865 and 3,071,274.

1. Opening the container does not tear metal and therefore does not deposit metal fragments over the top of the stopper.

2. The inner and outer seals are attached in two separate steps, allowing for a surprisingly advantageous inspection for presence of stopper and absence of dimpling of the stopper.

3. There is no possibility of creating jagged edges of torn metal that could cut the users fingers.

In addition, the present invention does not sacrifice the advantages of being pilfer-proof and openable by using only one hand with a flick of the thumb. Furthermore, the invention is simple and inexpensive to make.

What is claimed is:

1. A pilfer-proof container for injectable fluid comprising:

(a) a bottle having a neck, (b) an elastomeric stopper sealing said neck, (c) a inner seal fixedly secured to said neck to hold said stopper, said inner seal having an opening to allow penetration of said stopper, and (d) an outer seal covering said opening removably attached to said inner seal with adhesive adapted to seal around said opening, said adhesive being non-flaking and non-rebondable upon removal of said outer seal.

2. The container of claim 1 wherein said adhesive is thermoplastic.

3. The container of claim 2 wherein said thermoplastic is selected from the group consisting of polyvinyl chloride, polyethylene, polypropylene, ethylene copolymers, propylene copolymers, and blends thereof.

4. The container of claim 3 wherein said neck has a flange and said inner seal is secured to said neck by crimping said inner seal under said flange.

5. The container of claim 4 wherein said outer seal is aluminum having thickness of 0.003" to 0.01".

6. The container of claim 5 wherein said outerseal has a channel surrounding said opening and said seals are attached to each other only at said channel.

7. A closure for a container of injectable fluid comprising:

(a) an inner seal having an opening adapted to be fixedly secured to a container's neck, (b) an outer seal adapted to cover said opening, and (c) adhesive bonded to at least one of said seals adapted to removably attach said seals and to seal around said opening, said adhesive being non-flaking and non-rebondable after attachment and subsequent separation of said seals.

8. The closure of claim 7 wherein said adhesive is thermoplastic laminated to a least one of said seals.

9. The closure of claim 8 wherein said thermoplastic is selected from the group consisting of polyvinyl chloride, polyethylene, polypropylene, ethylene copolymers, propylene copolymers, and blends thereof.

10. A method of assembling and inspecting a container of injectable fluid wherein said container has a neck comprising the steps of:

(a) sealing said neck with an elastomeric stopper, (b) fixedly securing an inner seal to said neck to hold said stopper, said inner seal having an opening to allow penetration of said stopper, (c) inspecting the bottle-stopper-inner seal assembly produced in step (b) for presence of stopper and absence of dimpling, and, thereafter for assemblies passing inspection (d) removably affixing an outer seal over said opening with adhesive adapted to seal around said opening, said adhesive being non-flaking and non-rebondable upon removal of said outer seal.

11. The method of claim 10 wherein said adhesive is thermoplastic.

12. The method of claim 11 wherein said thermoplastic is selected from the group consisting of polyvinyl chloride, polyethylene, polypropylene, ethylene copolymers, propylene copolymers and blends thereof.

13. The method of claim 12 wherein said adhesive is laminated to at least one of said seals prior to said step (d) affixing, and wherein said affixing is performed by melting said thermoplastic.

14. The method of claim 13 wherein said melting is performed by applying ultrasonic energy to said adhesive.

15. The method of claim 13 wherein at least one of said seals is constructed of metal, and wherein said melting is performed by inductively heating said metal seal.

16. The method according to any one of claims 13, 14 or 15, wherein said inspection is performed by automatic inspecting means.

* * * * *